US005302154A

United States Patent [19]

Sundstrom et al.

[11] Patent Number: 5,302,154

[45] Date of Patent: Apr. 12, 1994

[54] POOL TABLE BALL RETURN CONTROLLER

[75] Inventors: Robert D. Sundstrom, Biwabik; Robert L. Thomas, Virginia, both of Minn.

[73] Assignee: Nortech, Inc., Virginia, Minn.

[21] Appl. No.: 756,892

[22] Filed: Sep. 9, 1991

[51] Int. Cl.[5] ..... A63D 15/00

[52] U.S. Cl. ..... 473/24

[58] Field of Search ..... 273/11 C, 11 R, 14, 273/2, 352, 121, 128 R, 128 V

[56] References Cited

U.S. PATENT DOCUMENTS

| | | | |
|---|---|---|---|
| 971,128 | 9/1910 | Goss . | |
| 1,137,736 | 5/1915 | Barnard | 273/11 R |
| 1,227,833 | 5/1917 | Russell | 273/11 R |
| 1,230,059 | 6/1917 | Andrews | 273/11 R |
| 2,756,998 | 7/1956 | Fisher | 273/11 |
| 3,096,981 | 7/1963 | Fischer | 273/11 C |
| 3,358,995 | 12/1967 | Braun et al. | 273/11 C |
| 3,618,943 | 11/1971 | Milu | 273/11 |
| 3,738,655 | 6/1973 | Feddick et al. | 273/59 |
| 3,825,258 | 7/1974 | Frierman | 273/2 |
| 3,891,074 | 6/1975 | Barnes | 273/11 C |
| 3,907,286 | 9/1975 | Murrey | 273/11 |
| 4,156,251 | 5/1979 | Anthony | 271/129 V |
| 4,466,036 | 9/1984 | Connelly | 273/125 |
| 4,524,968 | 6/1985 | Dölp | 273/2 |
| 4,979,739 | 12/1990 | Allen | 273/11 C |

FOREIGN PATENT DOCUMENTS

| | | | |
|---|---|---|---|
| 517561 | 3/1955 | France | 273/11 R |

*Primary Examiner*—Theatrice Brown

*Attorney, Agent, or Firm*—Merchant, Gould, Smith, Edell, Welter & Schmidt

[57] ABSTRACT

A pool table ball controller is programmable to vary time, cost, and other parameters relating to money-operated pool tables. A piano-hinge-type guard retains the balls and is operated by an electric motor driving a linkage to raise and lower the guard. Since the electric motor can be stopped in the lowered position, timed pool play can be selected so that the balls will continue to return to the user rather than being retained. The controller can be used to select between timed and rack play for a user of the pool table or may be moved into a programming mode wherein operators of the table can set time parameters relating to length of time for timed play and costs for both timed and rack play. In addition, diagnostic and other messages are displayed on an LCD screen. The controller also allows for programming in periods of time wherein cost and time are varied and when limits may be placed on time play and also periods when either timed or rack play are prohibited.

7 Claims, 6 Drawing Sheets

POOL TABLE BALL RETURN CONTROLLER

BACKGROUND OF THE INVENTION

1. Field of the Invention

The present invention relates to game tables commonly known as pool tables and more particularly, to a device for programmably controlling the release of pool balls on money-operated pool tables.

2. Description of the Prior Art

The game of pool or billiards is a well known game played on a horizontal, rectangular-shaped table having a pocket in each corner of the table and two intermediate side pockets. The table further includes an opening at a side or end where the playing balls are extracted.

Money-operated pool tables are provided in restaurants, game saloons, and the like wherein customers conventionally pay to play pool. To release personnel from the difficulties of cashing game money, it is a known practice to provide devices which release pool balls upon the insertion of a predetermined sum of coins. The most common device comprises a slanted runway where the balls are held in place by a rotating cage until the cage is activated to release the balls into a holding pocket where the balls can be accessed. Activation is caused by the insertion of coins into a coin chute and manually pressing forward and releasing the chute handle. As each ball is driven into a pocket, it is trapped in the cage and remains trapped until the cage is re-activated. The cue ball is separated from the other balls by weight or a magnet, so that play may continue should the cue ball fall into a pocket.

There are several disadvantages to the prior art ball release mechanisms in coin operated pool tables. One disadvantage is that the guard is manually activated, thereby requiring the user to activate the guard by forcibly pressing the coin chute handle. In some instances, the chute may jam and cannot be forced to its desired position, causing balls to remain on the runway, thereby causing users to lose money and the operator to make repairs. Further, the mechanical counter which is used to maintain a coin count as a function of the number of times the coin mechanism is actuated can be bent or broken, causing an inaccurate count. Another disadvantage is that the device has a linkage between the coin chute and rotating cage that includes springs, bearings, lugs and other parts that loosen from their workable form. These parts shorten the life of the device and increase the frequency of repairs.

However, it is possible to overcome these disadvantages from coin operated pool tables. The problem of balls remaining on the runway after they have been released would be solved by lowering a guard instead of rotating a pivoting guard. Lowering the guard provides a smoother transition from the runway to the path leading to the outer holding chamber. The problems associated with manual activation of the cage could be overcome by a motor which, upon insertion of coins, activates the guard rather than manual activation. An easily actuated lowering gate would also eliminate some of the problems associated with complicated linkages having many parts.

Pool playing practices at money-operated pool tables have generated considerable interest in having the release cage remain activated for a predetermined time period, whereby the cage does not prevent the balls from passing through the slanted runway into the accessible holding pocket. U.S. Pat. No. 3,358,995 embodies this proposition through an invention that has a mechanical timer responsive to a manually reciprocated or oscillatory coin receiver for automatically setting the timer to operate. However, there are shortcomings with a timer activated release cage of the type described in U.S. Pat. No. 3,358,995. The device limits the user to time play only and does not provide for time play or paying by the rack. In addition, it does not allow the controller to vary the price during predetermined time periods, such as during league nights or during happy hour. Variations in price can only occur if the coin chute is replaced by a new chute. Although it is possible to vary time with cost, it involves purely mechanical adjustments that need to be made inside the device. Also, it may be desirable to make changes on the length of the play period for different times of the day or days of the week, depending on the type of play or number of people waiting to play.

It can be seen then that there exists a need for a reliable money-operated pool table that does not limit the user to timed or rack play only and which provides a player with an option to select between rack play and timed play. A need also exists for a table which allows the operator to vary the price of predetermined time periods as well as the price of rack play, as well as being able to vary length and cost of the timed play period, cost of one rack of play, or the date and time at which these variations will take place. The present invention addresses these, as well as other problems associated with money-operated pool tables.

SUMMARY OF THE INVENTION

The present invention is directed to a device that programmably controls the release of pool balls in money-operated pool tables.

An objective of the present invention is to provide a programmable controller whereby the insertion of coins of a predetermined denomination, the amount being programmably variable, will allow the user to select timed or rack play, thereby releasing the pool balls in a pool table for manual transfer for one or more racks of play or for play in which balls fall freely into the holding pocket until the expiration of a predetermined time period related to the money deposited.

A further object of the invention resides in the capability to program the game whereby it allows an unlimited number or sets a maximum number of racks that can be played, or allows unlimited extensions of time or sets a maximum amount of time that a game can be extended.

Another object of the invention resides in providing the capability to programmably vary the number of minutes that will be allowed for a specified amount of money and the amount of money required to activate one rack of play.

A further object of the invention resides in providing the capability to programmably control the time and date upon which variances in time or cost occur.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings wherein like reference numerals and letters indicate corresponding elements throughout the several views.

DETAILED DESCRIPTION OF THE PREFERRED EMBODIMENT

Figure 1:
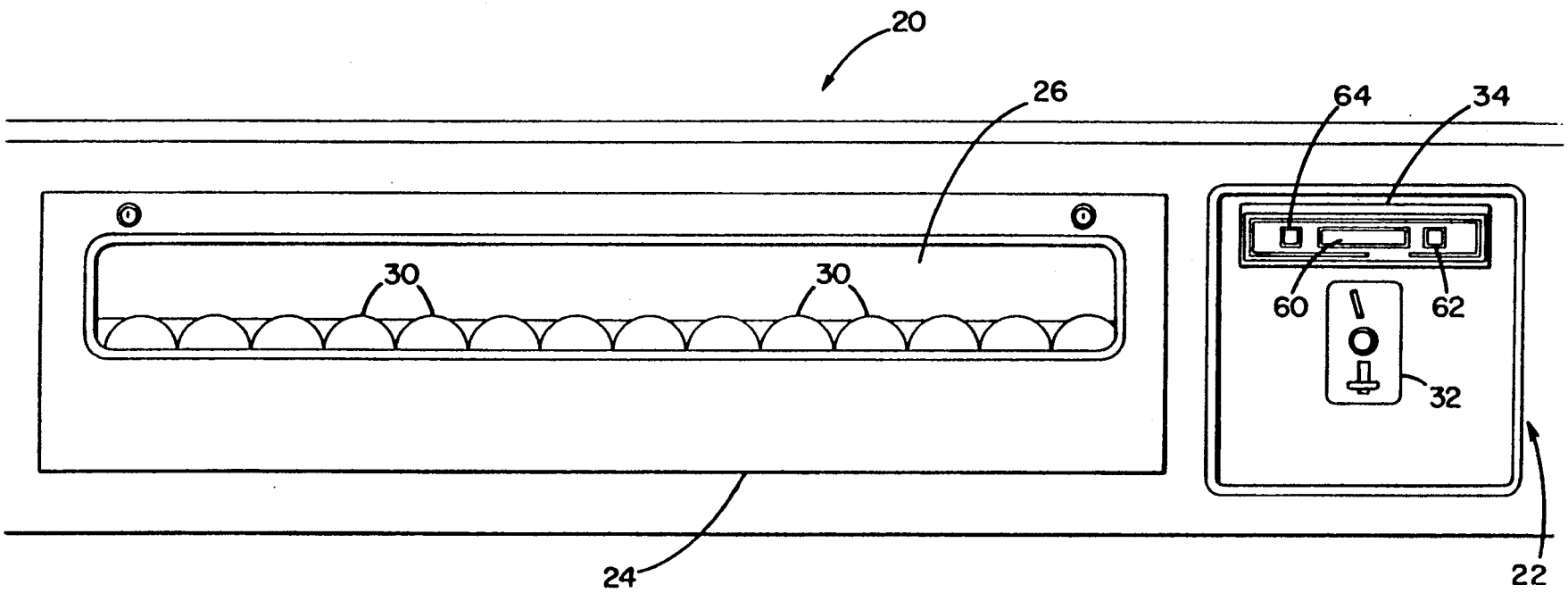
FIG. 1 shows an elevational view of a side of a pool table with a programmable ball release mechanism according to the principles of the present invention.

Referring now to the drawings, and in particular to FIG. 1, there is shown a money-operated pool table 20, such as used in pool halls, arcades, saloons and the like. At a side of pool table 20 is a ball-holding chamber 24 with a viewing window 26 which exposes the pool balls 30 to users. In addition, a control module of a controller 34 has an LCD back lit display screen 60 mounted within the coin or currency door enclosure area 22. The coin or currency door enclosure area 22 also contains a new coin drop type coin mechanism or dollar bill acceptor 32 mounted on the coin door, for accepting payment from users of the table 20. The controller 34 may be built into newly manufactured pool tables or may be easily installed on existing coin-operated tables 20. The controller 34 utilizes a low power use microprocessor which can be programmed to allow a user to select between rack or timed play and also permits an operator of the table to vary the cost, type of play, and periods for type of play, as explained hereinafter.

Figure 2:
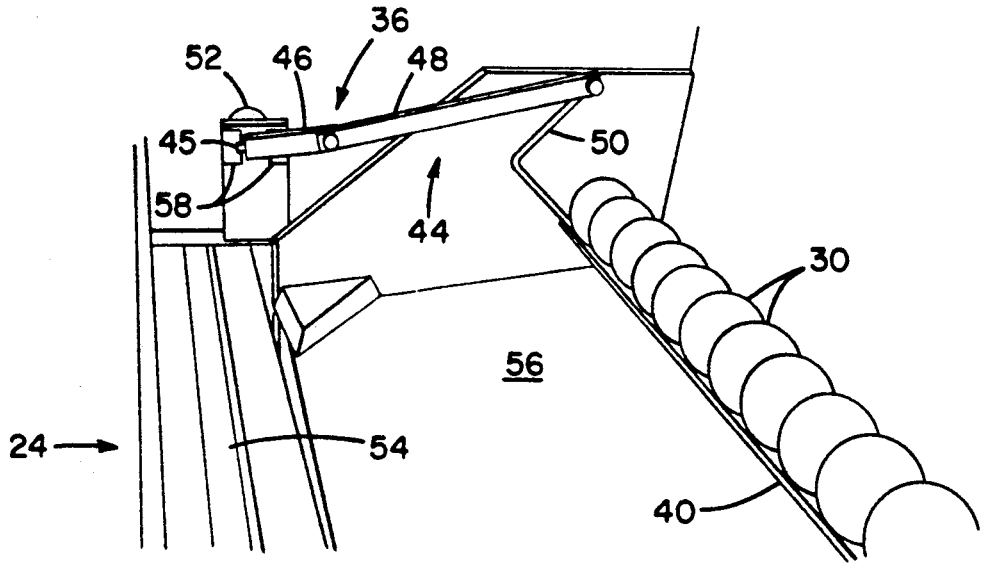
FIG. 2 shows a perspective view of a ball-holding chamber and the ball rack in a raised position for retaining the pool balls.
Figure 3:
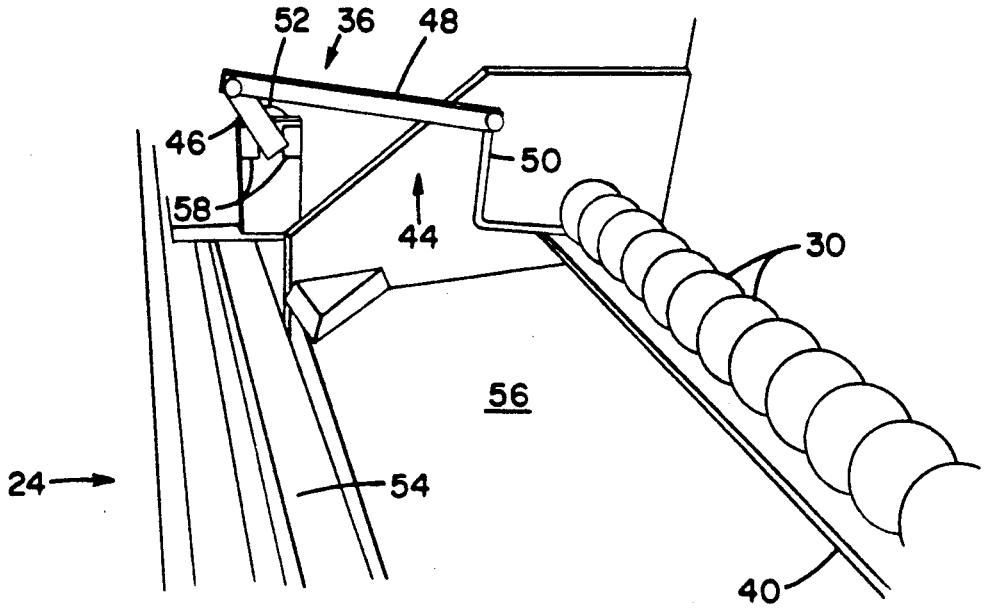
FIG. 3 shows a perspective view of the ball-holding chamber shown in FIG. 2 with the linkage actuated a portion of the way through the release portion wherein the card is partially lowered but the balls are not yet released.
Figure 4:
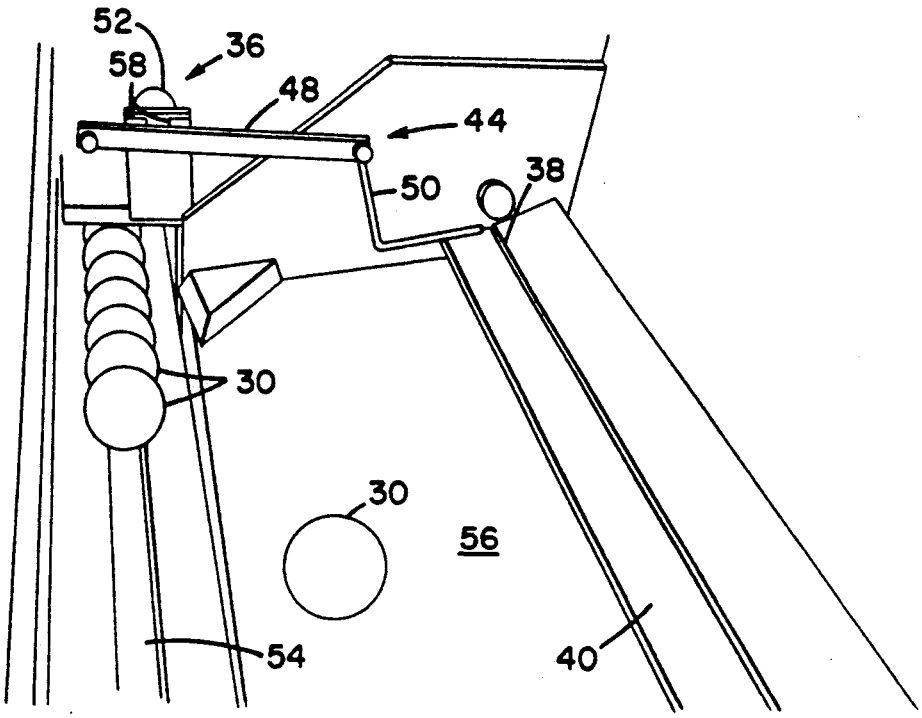
FIG. 4 shows a perspective view of the linkage actuated with the guard totally lowered and the balls released.
Figure 5:
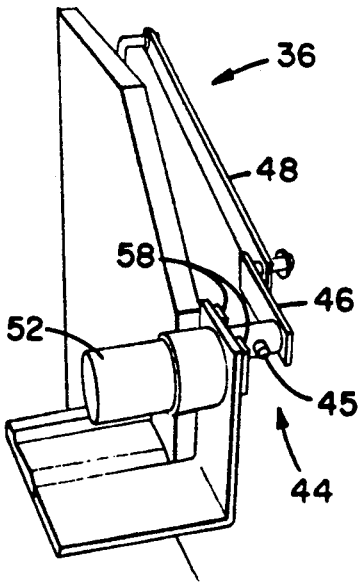
FIG. 5 shows a perspective view of the release linkage motor and the linkage.

As shown in FIG. 5, a release mechanism 36 releases the pool balls 30 upon actuation from the control module 34 (not shown in FIG. 5). As also shown in FIGS. 2–4, the release mechanism 36 has a linkage 44 to raise and lower a guard 40 which retains and releases the pool balls 30. The guard 40 is mounted against the ball rail mounted on the floor of the chamber 24 on a piano-type hinge 38, shown in FIG. 4. When the pool balls 30 are shot into a pocket of the table 20, they roll along a series of ramps and are directed onto the guard 40 where they are retained. Or, as explained hereinafter, the balls 30 will roll down the lowered guard 40, shown in FIG. 4, to trough 54 which directs the balls 30 to an accessible holding area where the ball can be put back in play by a user of the table 20.

The guard 40 is connected by the linkage 44 to an electric motor 52. The motor 52 receives power from rechargeable batteries. The shaft of the motor 52 connects to a crank shaft 46 which rotates with the motor 52. The crank shaft 46 connects to a first end of a middle connecting link 48 which connects to a right angled link member 50 mounting on the guard 40. When the motor 52 is energized, the linkage 44 raises and lowers the guard 40.

Referring now to FIG. 2, the guard 40 is in a raised position retaining the pool balls 30. Upon energization of the motor 52, the shaft 46 begins to rotate so that the crank shaft 46 rotates upward as shown in FIG. 3, thereby forcing the middle link 48 to pull the bent link 50 downward along with the guard 40. At this point, the balls 30 are not yet released, but continued rotation of the motor 52 actuates the linkage 44 so that the bent link 50 is pulled all the way down, as shown in FIG. 4. A magnet 45 on crank shaft 46 passes by a Hall Effect transistor 58 to signal the microprocessor that the guard 40 is fully lowered, and to stop the motor to release the pool balls 30 or leave the guard 40 down for timed play. This releases the pool balls 30 so that they roll down a ramp 56 into the trough 54. For rack play, the motor 52 would continue rotating back to the position shown in FIG. 2, thereby raising the guard 40 so that the pool balls 30 would be retained. For timed play, the guard 40 would remain down for the duration of the time paid for and then be raised when time expires. Upon raising the guard 40, the magnet 45 on the crank shaft 46 passes by a second Hall Effect transistor 58 to signal the microprocessor that the guard 40 is raised. It can be appreciated that the linkage 44 is simple and reliable and that it is electrically actuated rather than manually actuated with a release mechanism mechanically connected to the two-way push-type coin chute. This type of release also provides for maintaining the guard 40 in a down position by stopping the rotation of the motor 52. This provides for continued play wherein the balls 30 are not retained so that timed play may be selected.

Figure 8:
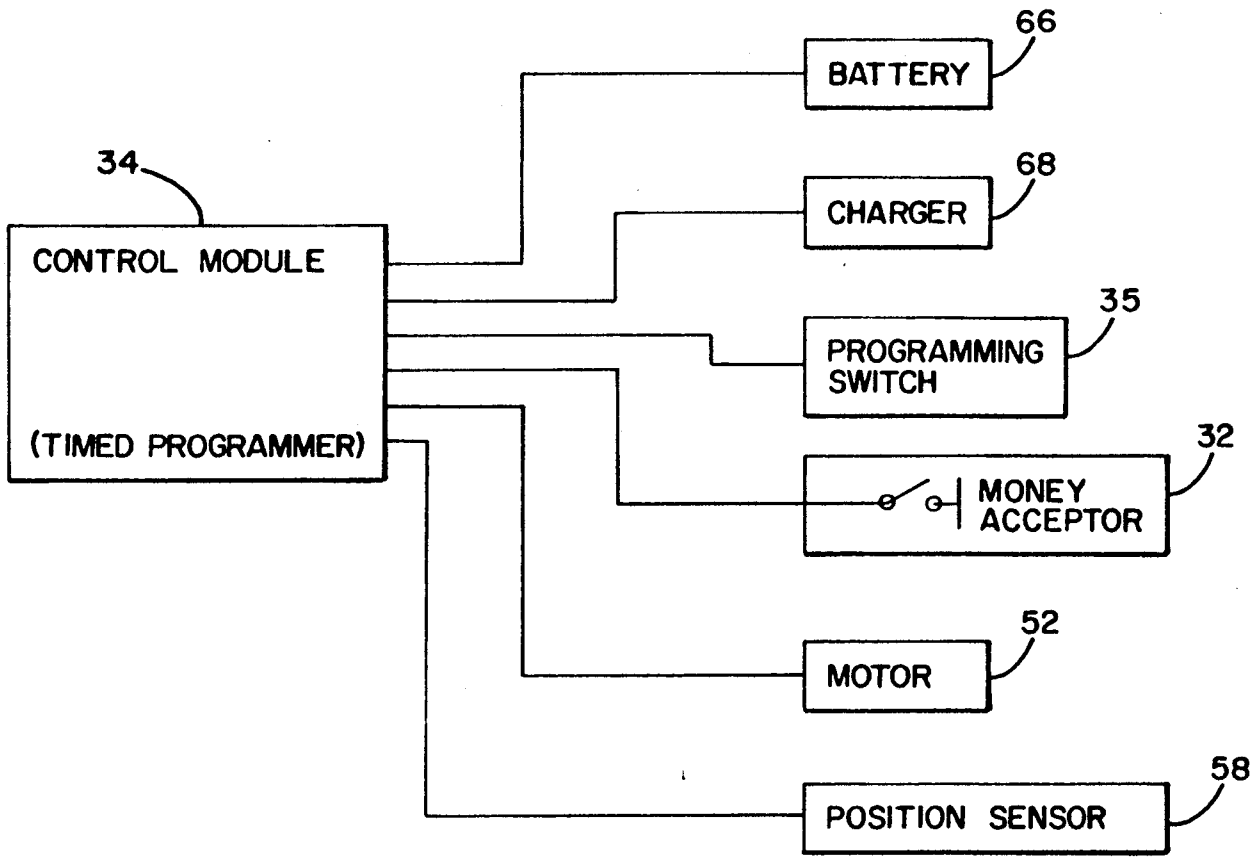

FIG. 8 shows the control diagram for the pool table controller. The pool table controller has a timed programmer module 34 which includes the display screen and the associated money acceptor 32. The money acceptor 32 and programmer 34 are powered by a battery 66 which in the preferred embodiment is rechargeable with a charger 68. The system is normally idle as indicated by the money acceptor 32 until money is deposited and the circuit closes. This flashes a message on the panel from the controller 34.

Actuation of the release mechanism is done by interfacing with the control module 34. Upon depositing sufficient funds into the money acceptor 32, a user would select either timed or rack play, the control module 34 would then close the circuit to the motor 52, thereby lowering the release mechanism and allowing pool balls to be put into play. When the gate is lowered, the position is sensed by the Hall Effect transistors 58 and relayed to the control module 34. The control module 34 will again energize the motor 52 to rotate the linkage to raise the guard so that pool balls are no longer put back in play when shot into a pocket of the table. If the table operators wish to program the various play parameters, switch 35 is moved to a programming mode so that the cost, time and other parameters may be entered, as explained hereinafter.

Figure 7:
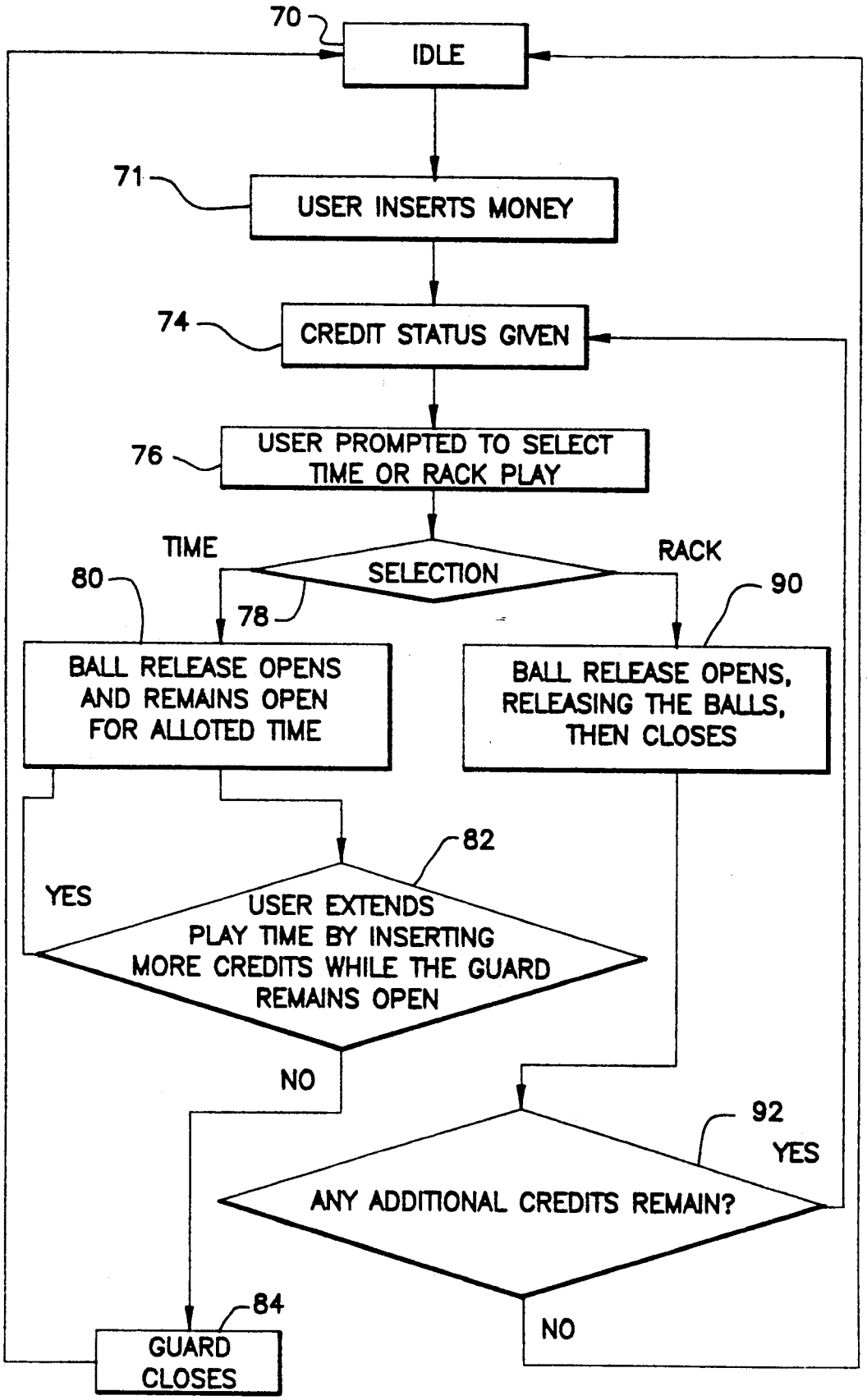
FIG. 7 shows a block diagram for a user of the pool table in programming for time or rack play; and, FIG. 8 shows an schematic diagram of the pool table controller.

As shown in FIG. 7, there is a block diagram for a user of the table in operating the programmable controller. In the preferred embodiment, the programmer is normally idle as represented by block 70 to save the batteries which power the system. However, there may be prompts prior to any action by a user which could appear on the screen, such as the amount of money required to play a rack of pool balls or for alerting the user as to the availability of either timed or rack play. Upon inserting money, as shown by block 72, in the preferred embodiment the screen gives a prompt giving the status of the number of credits, playing time, or racks of play which the user is entitled to. The user may continue to insert additional coins or currency to increase the number of credits or playing time obtained. When a sufficient amount of money has been inserted so that the user can select either rack play or timed play, the screen will prompt the user to make the selection between timed or rack play as represented by block 76. The user will then press either the time button 62 or the rack play button 64 as shown in FIG. 1 to make the selection as to the type of play. This is represented by decision diamond 78 in FIG. 7.

As explained hereinafter, there will be periods which may be programmed by the pool table operators in which a user is not allowed to select either timed or rack play. If this is the case, the sequence will follow to block 80 if the release apparatus is programmed for time play only or to block 90 if the controller is programmed for rack play only. If the user is restricted to rack play or if the user selects rack play, the release mechanism will be actuated and the balls will drop down as illustrated in FIGS. 2–4. As indicated by decision block 92, if credits remain, the screen 60 shown in FIG. 1 will indicate additional credits remain so that a user may play additional games or if needed, insert additional money to play additional games. If no credits are remaining, the programmer will return to an idle status as indicated by block 70. Referring to decision block 92, if additional credits remain, the status of the credits remaining will be displayed as indicated by block 74 and the user may insert additional coins or, if sufficient credits are left from the user already inserting money to pay for the cost of a rack or for timed play, the user may select between either rack or timed play, as indicated by block 76.

If a user selects timed play, as indicated by the diamond 78 in FIG. 7, the ball release opens and remains open for the allotted time which has been paid for, as indicated by block 80. As long as the guard 40 remains down as shown in FIG. 4, the user can insert additional money to extend the playing time, as indicated by decision block 82 in FIG. 7. A prompt may signal the players that the time is up or that a predetermined amount of time remains before the gate will raise to alert the players. By inserting additional money, the release mechanism will remain down so that play may continue on as indicated by decision block 82. This step may be repeated unless a time limit has been programmed by the table operators, as explained hereinafter. If timed play has been selected and the guard has been raised, as indicated by block 84 in FIG. 7, the programmer will go idle as indicated by block 70. However, players may add to their time of play by inserting additional monies and programming in additional time as explained above.

Figure 6:
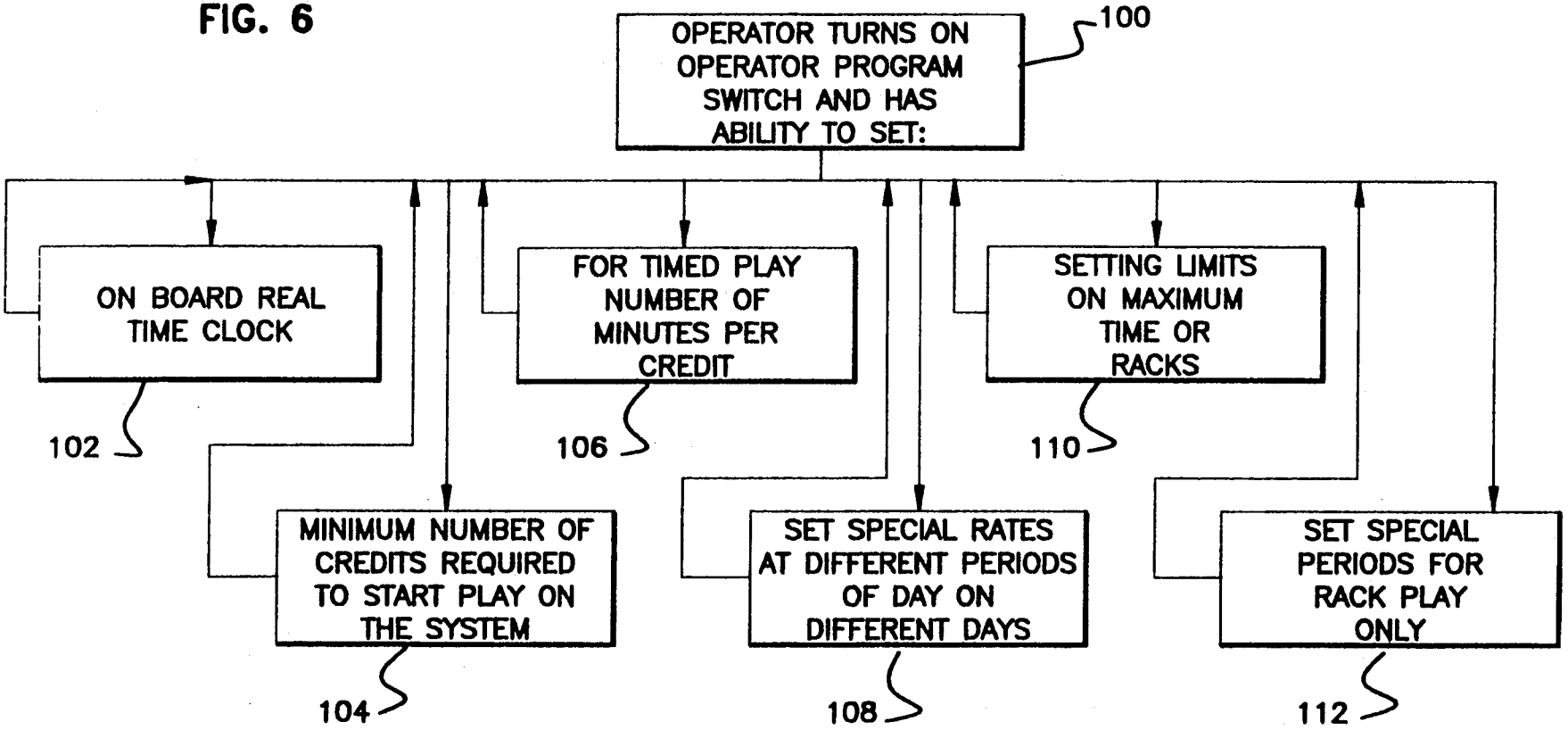
FIG. 6 shows a block diagram for programming cost and time parameters by the pool table operator.

In FIG. 6, there is shown a block diagram for the operator of the pool table to program the various parameters for controlling play on the table. When a switch inside of the pool table, which can be accessed only by the pool table operators is set to an operations mode, as indicated by block 100 in FIG. 8, the operator is able to program various parameters which control the cost and types of play on the table. An on-board real time clock allows delayed programming so that various parameters can be entered for different periods of time during different days of the week. For example, during happy hour, rates can be lowered, or when the table is being used for league play, the table can be set for timed play only. Also during very busy times, when a higher turnover would be preferred, limits can be set on the amount of time which a player can request.

With a real-time clock 102, setting periods for timed or rack play can be accomplished with the programmable controller represented by block 100. The on-board clock 102 also allows changing the time allotted for given amounts of money paid. In addition, the cost of play can be varied both as to the number of credits required to initially access the balls as represented by block 104 and the time required for additional minutes or additional racks, as indicated by block 106. These rates can be varied as explained above for different days of the week and different periods during the day, as indicated by block 108. In addition, the types of play can be limited to either timed or rack play, as indicated by block 110 and the limits on maximum time allowed for each player can also be limited, as shown by block 112. It can be appreciated that the programming capabilities and clock provide for setting several different rates as well as setting several different time limits, and several restrictions to type of play. This provides for versatility in playing that is not possible with other timed pool tables.

The screen 60 of the programming panel 34 shown in FIG. 1 issues prompts to a user to indicate the number of credits, the cost of the game, the amount deposited, whether rack or time play is available, and if time play is available, how much time is remaining. Also readable by the operator are counters maintaining records of numbers of coins and the numbers and types of play selected. In addition, if there are problems in the system, such as a coin jam or a battery which has run low, as well as other test/diagnostic features, these diagnostic messages will be communicated on the screen 60.

The screen 60 also acts as an interactive link between an operator programming the controller 34 and the microprocessor of the controller 34. As an operator is programming the controller, the screen 60 will give prompts directing the operator how to set various parameters. In addition to the screen, the timed and rack play buttons 62 and 64 are used for setting the various parameters and also interact with the microprocessor of the controller 34. The controller 34 takes an operator step-by-step through the programming process to set the various time, and other parameters for the pool table.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An apparatus for controlling the release of pool balls in money-operated pool tables, comprising:

a pivotally mounted guard movable between a raised position and a lowered position, said guard being adapted to hold pool balls in place when in said raised position and to release the balls when in the lowered position;

an electrically powered motor; linkage means connecting said motor to said guard for raising and lowering the guard upon activation of the motor; and, Hall Effect transistors electrically connected to said motor for sensing the position of said linkage, control means electrically connecting and transistors to said motor for activating and deactivating said motor when said linkage is in a prescribed predetermined position.

2. An apparatus for controlling the release of pool balls in money-operated pool tables, comprising:

a pivotally mounted guard movable between a raised position and a lowered position, said guard being adapted to hold pool balls in place when in said raised position and to release the balls when in said lowered position;

a motor;

means for activating the motor;

linkage means connecting said motor to said guard whereby said guard will be raised and lowered upon activation of the motor, said linkage being comprised of a shaft of the motor connected to a crank shaft, a straight connecting rod connected at a first end to the crank shaft and at a second end to an angled connecting rod, the angled connecting rod connected at a first end to the straight connecting rod and at a second end to an edge of the guard.

3. An apparatus as claimed in claim 2, wherein the angle of said angled connecting rod is a right angle.

4. An apparatus for controlling the release of pool balls in money-operated pool tables, comprising:

a pivotally mounted guard movable between a raised positioned and a lowered position, said guard being adapted to hold pool balls in place when in said raised position and to release the balls when in said lowered position;

a motor, and means for activating said motor;

linkage means connecting said motor to said guard for raising and lowering and guard upon activation of the motor; and means for programmably controlling activation of said motor, thereby controlling said lowering and raising the guard, and further controlling time length of the delay period between the lowering and raising of the guard.

5. An apparatus as claimed in claim 4, wherein lowering and raising of the guard is activated by a sensing device that senses the position of the motor's rotating link.

6. An apparatus as claimed in claim 4, wherein the delay period is activated when a sensing device senses the position of the motor's rotating link.

7. An apparatus as claimed in claim 4, wherein said programmable controlling means enables a controller to define and manipulate the amount of time or number of racks that can be selected.

* * * * *